US007048521B2

(12) United States Patent
Kondo

(10) Patent No.: US 7,048,521 B2
(45) Date of Patent: May 23, 2006

(54) HIGH PRESSURE FUEL SUPPLY PUMP WITH AN INTAKE VALVE MEMBER AND A DISCHARGE VALVE MEMBER ALIGNED ALONG A PLUNGER AXIS

(75) Inventor: Jun Kondo, Obu (JP)

(73) Assignee: Denso Corporation, Kariya (JP)

( * ) Notice: Subject to any disclaimer, the term of this patent is extended or adjusted under 35 U.S.C. 154(b) by 359 days.

(21) Appl. No.: 10/724,607

(22) Filed: Dec. 2, 2003

(65) Prior Publication Data

US 2004/0105763 A1 Jun. 3, 2004

(30) Foreign Application Priority Data

Dec. 3, 2002 (JP) ..... 2002-351252

(51) Int. Cl.
*F04B 7/04* (2006.01)

(52) U.S. Cl. ..... 417/443; 417/273; 417/470; 417/471; 417/569; 417/570

(58) Field of Classification Search ..... 417/443, 417/273, 470, 471, 569, 570
See application file for complete search history.

(56) References Cited

U.S. PATENT DOCUMENTS 5,123,819 A * 6/1992 Schuller et al. ..... 417/569
5,232,273 A * 8/1993 Eckstein et al. ..... 303/116.4
5,320,498 A * 6/1994 Fuchida ..... 417/214
6,079,961 A * 6/2000 Schuller et al. ..... 417/549
6,126,418 A * 10/2000 Sinnl ..... 417/470
6,283,724 B1 * 9/2001 Alaze et al. ..... 417/273
2002/0009373 A1 1/2002 Ruthardt et al.

* cited by examiner

*Primary Examiner*—Charles G. Freay
*Assistant Examiner*—Emmanuel Sayoc
(74) *Attorney, Agent, or Firm*—Nixon & Vanderhye P.C.

(57) ABSTRACT

In a high pressure fuel supply pump, a housing is provided with a through-hole having a step. A plunger is slidably accommodated in the through-hole on an axial end side thereof. An intake valve member is positioned in the through-hole on an axially opposite side to the plunger with respect to the step so that a pump chamber is formed between the plunger and the intake valve member. A discharge valve member is positioned in the through-hole on an axially opposite side to the plunger with respect to the intake valve member. A plug is screw fastened into an inner wall of the through-hole on another axial end thereof so as to urge both of the discharge valve member and the intake valve member against the step so that the intake valve member and the discharge valve member are rigidly fixed in the through-hole.

9 Claims, 3 Drawing Sheets

HIGH PRESSURE FUEL SUPPLY PUMP WITH AN INTAKE VALVE MEMBER AND A DISCHARGE VALVE MEMBER ALIGNED ALONG A PLUNGER AXIS

CROSS REFERENCE TO RELATED APPLICATIONS

This application is based upon and claims the benefit of priority of Japanese Patent Application No. 2002-351252 filed on Dec. 3, 2002, the content of which is incorporated herein by reference.

BACKGROUND OF THE INVENTION

1. Field of the Invention

The present invention relates to a high pressure fuel supply pump, in particular, applicable to a supply pump to be used in a common rail type fuel injection system for a diesel engine.

2. Description of Related Art

A conventional high pressure fuel supply pump is composed of a housing having a cylinder in which a plunger is slidably accommodated and a cylinder head in which an intake valve and a discharge valve (a check valve) are provided. According to the high pressure fuel supply pump disclosed in JP-P-2001-500593A, the cylinder head is composed of a plate in which both of the intake valve and the discharge valve are arranged and the cylinder head is attached to and fastened with the housing. This structure has a problem that fastening means for fixing the cylinder head to the housing is relatively large and complicated, since the fastening means has to endure pump chamber high pressure which the cylinder head receives, resulting in higher assembly cost and heavier body weight.

To cope with this problem, a high pressure fuel supply pump P, as shown in FIGS. 3A to 3C, is actually used. According to the high pressure fuel supply pump P, a plunger 2 is slidably accommodated in a cylinder 20 provided at a lower portion of a housing 1. An intake valve 3 is arranged at a head portion of the housing 1 coaxially with the cylinder 20 and a discharge valve 4 is arranged at a side portion of the housing 1 perpendicular to an axis of the cylinder 20. Since the intake valve 3 and the discharge valve 4 can be rigidly fixed by plugs 3A and 4A, respectively, structure of fastening the intake valve 3 and the discharge valve 4 is relatively simple and the pump P can be manufactured at less assembly cost. However, the supply pump P has a drawback in which a discharge port or conduit 18 for delivering high pressure fuel is opened to an inner circumferential wall of the cylinder 20.

In the supply pump P in which the discharge port 18 is opened to the cylinder 20 in a direction of crossing the cylinder 20, stress is concentrated to upper and lower peripheries 4C and 4D of the discharge port 18, as shown in FIG. 3B, when high pressure is applied to an inner cylindrical surface of the cylinder 20, as shown in FIG. 3C. Concentration of stress adversely affects on life time and reliability of the upper and lower peripheries 4C and 4D of the discharge port 18. Accordingly, the housing 1 has to be made of higher hardness material and, therefore, the manufacturing process is complicated, which results in higher manufacturing cost.

SUMMARY OF THE INVENTION

An object of the present invention is to provide a high pressure fuel supply pump in which stress is hardly concentrated on an inner wall of a cylinder. Accordingly, the cylinder is manufactured at lower cost in use of material that can be easily processed and longer life time and reliability of the supply pump are assured.

To achieve the above object, in the high pressure fuel supply pump, a housing is provided with a through-hole having a step. A plunger is slidably accommodated and reciprocatingly movable in the through-hole extending from an axial end thereof to the step. An intake valve member is positioned in the through-hole on an axially opposite side to the plunger with respect to the step and in contact with the step so that a pump chamber is formed between the plunger and the intake valve member. The intake valve member is provided with an intake check valve through which fuel is supplied to the pump chamber when the plunger moves in an opposite direction to the step. A discharge valve member is positioned in the through-hole on an axially opposite side to the plunger with respect to the intake valve member and in contact with the intake valve member. The discharge valve member is provided with a discharge check valve through which fuel is discharged from the pump chamber when the plunger moves toward the step. A plug is screw fastened into an inner wall of the through-hole on another axial end thereof.

With the pump mentioned above, the plug axially urges both of the discharge valve member and the intake valve member against the step so that the intake valve member and the discharge valve member are rigidly fixed in the through-hole.

This structure is relatively simple and easily fabricated at lower cost. Further, since there is no stress concentration on the inner wall of the cylinder, the pump has longer life time and better reliability. Furthermore, since the intake valve member and the discharge valve member can be fixed simultaneously by a single piece of the plug, the manufacturing cost is lower.

It is preferable that the intake check valve and the discharge check valve are positioned substantially in a column shaped region defined by axially casting a reflection of an axial end surface of the plunger on a side of the pump chamber.

With this structure, the pump can be easily fabricated at a lower cost without causing pressure loss.

Preferably, the housing is provided with an intake port. A ring shaped intake conduit is formed between an inner circumference of the through-hole and an outer circumference of the intake valve member. The intake valve member is provided in an interior thereof with an intake passage in which the intake check valve is installed, whose one end is opened to the pump chamber and whose another end communicates with the intake port via the ring shaped intake conduit.

The intake valve member having the above structure is easily fabricated at lower cost.

It is preferable that the discharge valve member is provided in an interior thereof with a discharge passage in which the discharge check valve is installed and the intake valve member is provided in an interior thereof with a discharge conduit which is formed separately from the intake passage, whose one end is opened to the pump chamber and whose another end communicates with one end of the discharge passage.

The discharge valve member having the above structure is easily fabricated at lower cost.

Further, preferably, the plug is provided on an axis thereof with an axially penetrating discharge port communicating with another end of the discharge passage.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
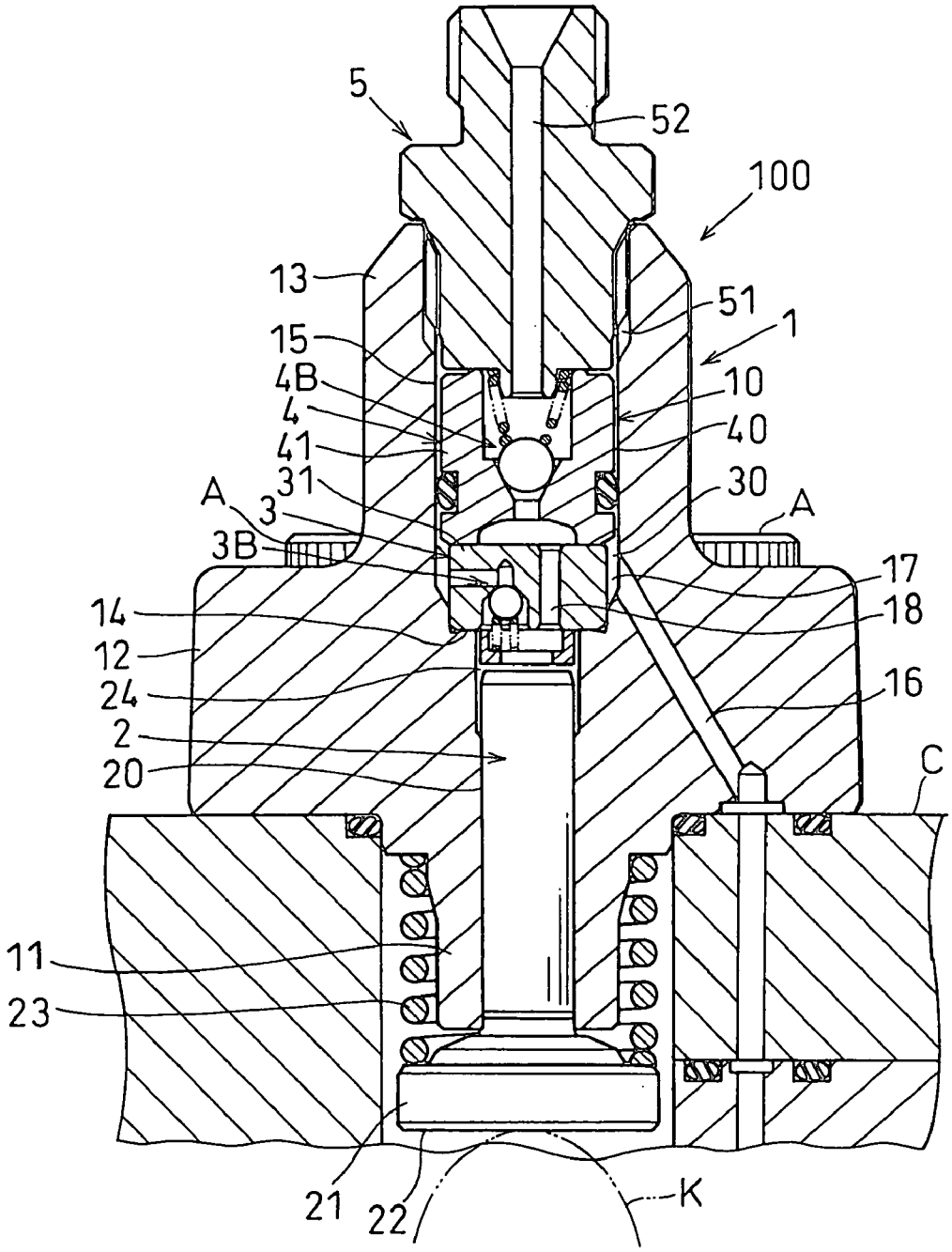
FIG. 1 is a cross sectional view of a high pressure fuel supply pump according to an embodiment of the present invention.
Figure 2:
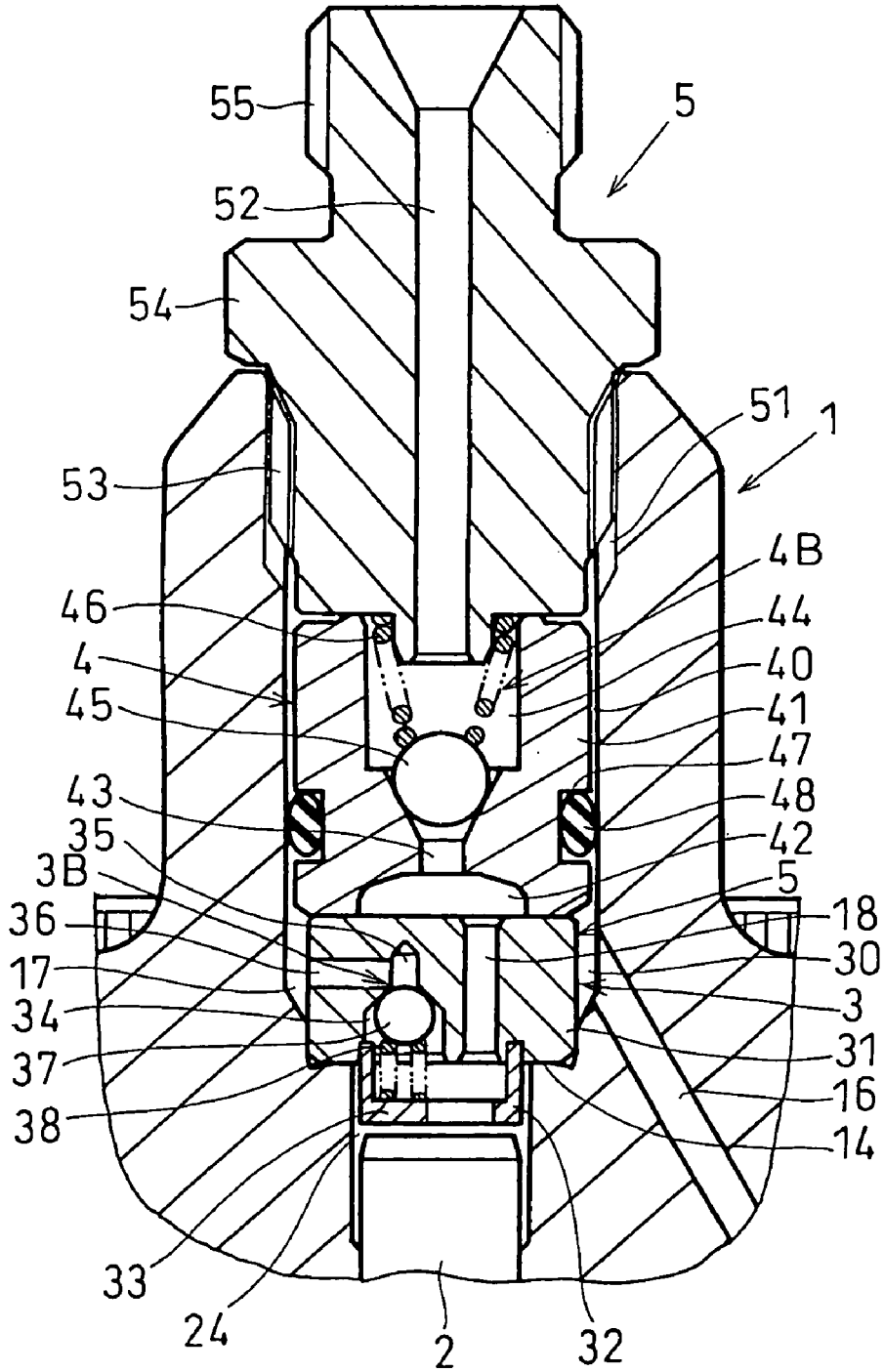
FIG. 2 is a cross sectional view of a main part of the high pressure fuel supply pump of FIG. 1.
Figure 3A:
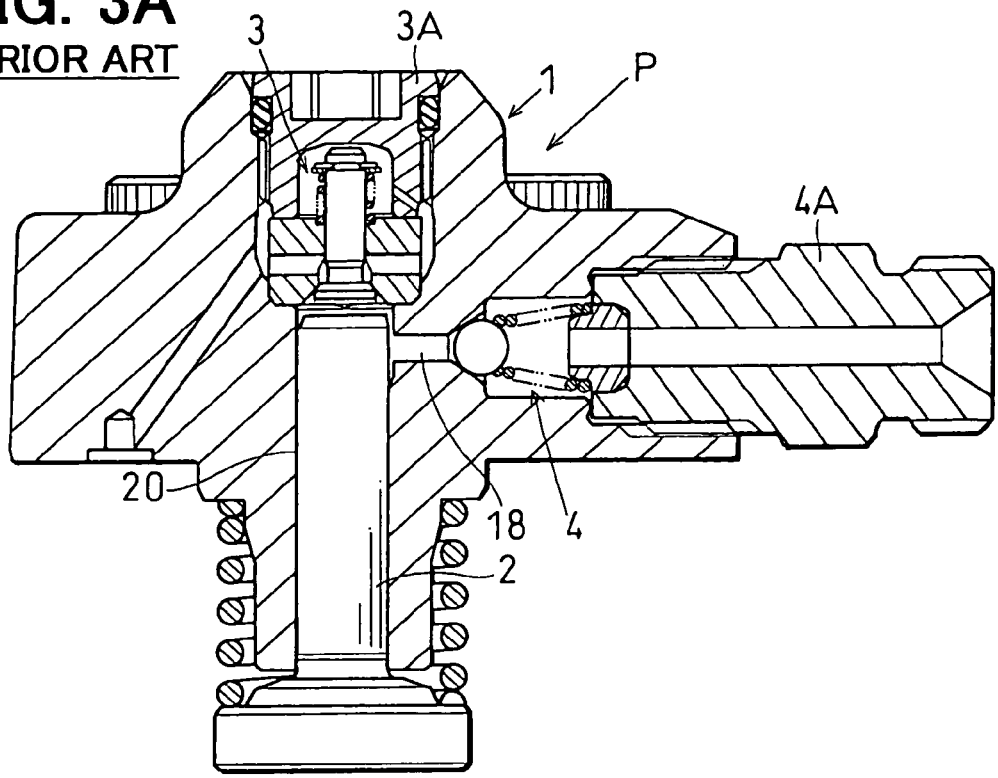
FIG. 3A PRIOR ART
FIG. 3A is a cross sectional view of a conventional high pressure fuel supply pump as a prior art.
Figure 3B:
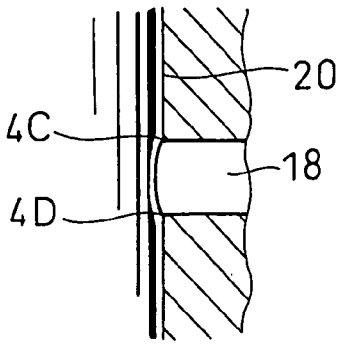
FIG. 3B PRIOR ART
FIGS. 3B and 3C are schematic cross sectional views of a part of the conventional high pressure fuel supply pump of FIG. 3A.
Figure 3C:
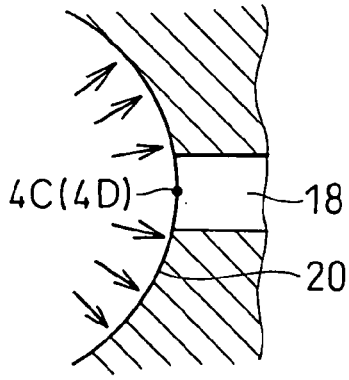
FIG. 3C PRIOR ART

An embodiment of the present invention is described with reference to FIGS. 1 and 2. A high pressure fuel supply pump 100 has a cylindrical housing 1 in which a through-hole 10 is provided. The housing 1 is composed of a small diameter end portion 1, a large diameter flange portion 12 and a middle diameter another end portion 13. The large diameter flange portion 12 is fixed to a pump casing C by fasteners A, A.

The through-hole 10 is provided on an axial end thereof (lower end in FIG. 1) with a cylinder 20 in which a plunger 2 is slidably accommodated. The through-hole 10 has a step 14 and the through-hole 10 on a side axially opposite to the plunger 2 with respect to the step 14 constitutes a large diameter hole 15. An intake valve member 3 in contact with the step 14 and a discharge valve member 4 adjacent to the intake valve member 3 are arranged axially in series in the large diameter hole 15. A plug 5 is screw fastened to another axial end inner wall of the through-hole 10 and pushes the discharge and intake valve members 4 and 3 against the step 14. The intake valve member 3, the discharge valve member 4 and the plug 5 constitute a cylinder head.

The plunger 2 is provided at an axial end thereof (lower end in FIG. 1) with a flange 21 whose diameter is larger than the other part of the plunger 2. A cam K acts on an end surface 22 of the flange 21 for driving the plunger 2. A return spring 23 for the plunger 2 is disposed between the large diameter flange portion 12 and the flange 21. A pump chamber 24, in which fuel is pressurized, is formed at an upper end portion of the cylinder 20 whose inner diameter is slightly larger than the other portion of the cylinder 20.

An intake valve chamber 30 and a discharge valve chamber 40 are arranged axially in series at a lower end of the large diameter hole 15 of the through-hole 10. The large diameter hole 15 is provided at an upper end thereof with a female thread 15. The housing 1 is provided with an intake port 16 for sucking fuel through which the intake valve chamber 30 communicates with a lower end surface of the large diameter flange portion 12.

The intake valve member 3 has a cylindrical intake valve body 31 which is accommodated in the intake valve chamber 30, whose lower axial end is in contact with the step 14 and whose lower circumferential end is fitted to an inner circumferential wall of the intake valve chamber 30. A ring shaped intake conduit 17 is formed between an outer circumferential wall of the intake valve body 31 and an inner circumferential wall of the intake valve chamber 30. The ring shaped intake conduit 17 communicates with the intake port 16. A spring holding tube 32 is attached to a lower end of the intake valve body 31 so as to protrude into the pump chamber 24. The spring holding tube 32 is provided with a spring seat 33.

The intake valve body 31 has an intake valve passage composed of a valve chamber 34 whose lower end is opened, a valve inlet 35 positioned above the valve chamber 34 and an intake bore 36 through which the valve inlet 35 communicates with the ring shaped intake conduit 17. A valve 37 is installed in the valve chamber 34. A spring 38 is disposed between the valve 37 and the spring seat 33 so that the valve 37 is urged toward the valve inlet 35. The valve 38, the valve chamber 34 and the spring 38 constitute an intake check valve 3B. The intake valve body 31 is provided with a discharge conduit 18 formed separately from the intake passage so as to penetrate from an upper end surface to a lower end surface thereof. High pressure fuel is delivered to the discharge valve member 3 through the discharge conduit 18.

The discharge valve member 4 has a cylindrical discharge valve body 41 which is accommodated in the discharge valve chamber 40 and whose lower axial end is in contact with an upper end of the intake valve body 31. The discharge valve body 41 has a discharge valve passage composed of a discharge conduit chamber 42 which is a recess portion formed on a lower surface thereof and communicates with the discharge conduit 18, a valve chamber 44 formed on an upper surface thereof, and an discharge inlet 43 through which the valve chamber 44 communicates with the discharge conduit chamber 42.

A valve 45 is installed in the valve chamber 44. A spring 46 is disposed between the lower end of the plug 5 and the valve 45. The valve 45 is urged toward the discharge inlet 43 by the spring 46. The valve 45, the valve chamber 44 and the spring 46 constitute a discharge check valve 4B. The discharge valve body 41 is provided on an outer circumference thereof with a ring shaped groove 47 into which a seal ring 48 is accommodated.

The plug 5 is provided on an axis thereof with a discharge port 52. The plug 5 is provided at an outer circumferential lower portion thereof with a male thread 53, at an outer circumferential middle portion thereof with a hexagon portion 54 for fastening and at an outer circumferential upper portion with a connection thread 55. The plug 5 urges the intake valve body 31 and the discharge valve body 41 against the step 14 by screwing the male thread 53 into the female thread 51 so that the intake valve member 3 and the discharge valve member 4 are fixed in the large diameter hole 15 of the through-hole 10.

The high pressure fuel supply pump 100 is used as a supply pump for a common rail type fuel injection system of a diesel engine. The plunger 2 is reciprocatingly moved according to rotation of the cam K. When the plunger 2 is at a downward stroke, the intake valve member 3 is at a valve opening position so that low pressure fuel is supplied to the pump chamber 24 through the intake port 16, the ring shaped intake conduit 17 and the intake check valve 3B. When the plunger is at an upward stroke, high pressure fuel is discharged from the pump chamber 24 to a common rail through the spring holding tube 32, the discharge conduit 18, the discharge check valve 4B and the discharge port 52.

According to the high pressure fuel supply pump 100, the discharge conduit, through which high pressure fuel is delivered from the pump chamber 24 to the discharge valve member 4, is formed in the intake valve body 31 constituting a ceiling of the cylinder 20. Further, the discharge check valve 4B is positioned substantially in a column shaped region defined by axially casting a reflection of an axial end surface of the plunger 20 on a side of the pump chamber 24. Accordingly, there is no stress concentration on the inner wall of the cylinder 20 and pressure loss hardly occurs in the discharge conduit or passage for delivering high pressure fuel to the discharge check valve since the discharge conduit or passage extends substantially in parallel with an axis of the plunger 20 without turning perpendicularly. The high pressure fuel supply pump 200 has longer life time and better reliability and can be manufactured at a lower cost, since the pump 200 uses material that can be easily processed.

Further, after the intake valve member 3 and the discharge valve member 4 are arranged coaxially with the plunger 20, the intake valve member 3 and the discharge valve member 4 are fixed in the through-hole 10 of the housing 1 by the plug 5. This structure is relatively simple and easily fabricated at lower cost. Further, since the intake valve member 3 and the discharge valve member 4 can be fixed simultaneously by a single piece of the plug 5 so that the assembly cost is lower, the total manufacturing cost is lower.

What is claimed is:

1. A high pressure fuel supply pump comprising:

a housing provided with a through-hole having a step;

a plunger slidably accommodated and reciprocatingly movable in the through-hole extending from an axial end thereof to the step;

an intake valve member positioned in the through-hole on an axially opposite side to the plunger with respect to the step and in contact with the step so that a pump chamber is formed between the plunger and the intake valve member, the intake valve member being provided with an intake check valve through which fuel is supplied to the pump chamber when the plunger moves in an opposite direction to the step;

a discharge valve member positioned in the through-hole on an axially opposite side to the plunger with respect to the intake valve member and in contact with the intake valve member, the discharge valve member being provided with a discharge check valve through which fuel is discharged from the pump chamber when the plunger moves toward the step; and a plug screw fastened into an inner wall of the through-hole on another axial end thereof so as to axially push both of the discharge valve member and the intake valve member against the step so that the intake valve member and the discharge valve member are rigidly fixed in the through-hole.

2. A high pressure fuel supply pump according to claim 1, wherein the housing is provided with an intake port communicating with the through-hole, a ring shaped intake conduit is formed between an inner circumference of the through-hole and an outer circumference of the intake valve member, and the intake valve member is provided in an interior thereof with an intake passage in which the intake check valve is installed, whose one end is opened to the pump chamber and whose another end communicates with the intake port via the ring shaped intake conduit.

3. A high pressure fuel supply pump according to claim 2, wherein the discharge valve member is provided in an interior thereof with a discharge passage in which the discharge check valve is installed and the intake valve member is provided in an interior thereof with a discharge conduit which is formed separately from the intake passage, whose one end is opened to the pump chamber and whose another end communicates with one end of the discharge passage.

4. A high pressure fuel supply pump according to claim 3, wherein the plug is provided on an axis thereof with an axially penetrating discharge port communicating with another end of the discharge passage.

5. A high pressure fuel supply pump according to claim 1, wherein the intake valve member and the discharge valve member are positioned coaxially with the plunger.

6. A high pressure fuel supply pump comprising:

a housing provided with a cylinder;

a plunger slidably accommodated and reciprocatingly movable in the cylinder;

a valve member attached to the housing at a position axially opposed to the plunger so that a pump chamber is formed between the plunger and the valve member at a through-hole having a step, the valve member being in contact with said step and provided with an intake check valve through which fuel is supplied to the pump chamber when the plunger moves in a direction away from the valve member and a discharge check valve through which fuel is discharged from the pump chamber when the plunger moves toward the valve member, wherein the intake check valve and the discharge check valve are positioned substantially in a column shaped region defined by axially casting a reflection of an axial end surface of the plunger on a side of the pump chamber.

7. A high pressure fuel supply pump according to claim 6, wherein the housing has a through-hole having a step, the through-hole on an axial end side of the step constituting the cylinder, the valve member is accommodated in the through-hole on a side axially opposite to the plunger with respect to the step.

8. A high pressure fuel supply pump according to claim 7, further comprising:

a plug screw fastened into an inner wall of the through-hole on another axial end thereof so as to axially push valve member against the step so that the valve member is rigidly fixed in the through-hole.

9. A high pressure fuel supply pump according to claim 8, wherein the valve member comprises an intake valve member in which the intake check valve is provided and which is in contact with the step and a discharge valve member in which the discharge check valve is provided and which is positioned on an axially opposite side to the plunger with respect to the intake valve member and in contact with the intake valve member.

* * * * *